US006820406B2

(12) United States Patent
Khavkine et al.

(10) Patent No.: US 6,820,406 B2
(45) Date of Patent: Nov. 23, 2004

(54) HYBRID YARNS WHICH INCLUDE PLANT BAST FIBER AND THERMOPLASTIC FIBER, REINFORCEMENT FABRICS MADE WITH SUCH YARNS AND THERMOFORMABLE COMPOSITES MADE WITH SUCH YARNS AND REINFORCEMENT FABRICS

(75) Inventors: Mikhail Khavkine, Newmarket (CA); Barbara Isman, Winnipeg (CA)

(73) Assignee: Cargill, Incorporated, Wayzata, MN (US)

( * ) Notice: Subject to any disclaimer, the term of this patent is extended or adjusted under 35 U.S.C. 154(b) by 0 days.

(21) Appl. No.: 10/144,673

(22) Filed: May 13, 2002

(65) Prior Publication Data

US 2003/0059610 A1 Mar. 27, 2003

Related U.S. Application Data

(60) Provisional application No. 60/290,840, filed on May 14, 2001.

(51) Int. Cl.[7] ..... D01H 7/62; D02G 3/00

(52) U.S. Cl. ..... 57/120; 57/119; 57/256; 428/393; 428/373

(58) Field of Search ..... 57/119, 120, 200, 57/210, 243, 244, 256, 3, 13; 428/377, 375, 373, 374, 392, 393

(56) References Cited

U.S. PATENT DOCUMENTS

| | | | | |
|---|---|---|---|---|
| 3,855,775 | A | * 12/1974 | Valdelievre | 57/239 |
| 4,800,113 | A | 1/1989 | O'Connor | |
| 4,913,937 | A | 4/1990 | Engdahl et al. | |
| 5,116,668 | A | 5/1992 | Yamamoto et al. | |
| 5,122,417 | A | 6/1992 | Murakami et al. | |
| 5,228,175 | A | 7/1993 | Olry et al. | |
| 5,348,796 | A | * 9/1994 | Ichibori et al. | 442/202 |
| 5,358,767 | A | 10/1994 | Bompard et al. | |
| 5,554,330 | A | 9/1996 | Flannery et al. | |
| 5,618,624 | A | 4/1997 | Dinger et al. | |
| 5,654,067 | A | 8/1997 | Dinger et al. | |
| 5,714,226 | A | 2/1998 | Disselbeck | |
| 5,720,083 | A | 2/1998 | Leduc et al. | |
| 5,741,382 | A | 4/1998 | Ma et al. | |
| 5,792,555 | A | 8/1998 | Bak et al. | |
| 5,856,243 | A | 1/1999 | Geirhos et al. | |
| 5,885,394 | A | 3/1999 | Scherzer et al. | |
| 5,888,609 | A | 3/1999 | Karttunen et al. | |
| 5,906,030 | A | 5/1999 | Leduc et al. | |
| 5,910,361 | A | 6/1999 | Guevel et al. | |
| 6,025,285 | A | 2/2000 | Vyakarnam et al. | |
| 6,051,313 | A | 4/2000 | Olry et al. | |
| 6,051,316 | A | 4/2000 | Boissannat et al. | |
| 6,054,177 | A | 4/2000 | Endoh et al. | |
| 6,079,647 | A | 6/2000 | Leduc et al. | |
| 6,114,416 | A | 9/2000 | Kolla et al. | |
| 6,133,348 | A | 10/2000 | Kolla et al. | |
| 6,139,956 | A | 10/2000 | Endoh et al. | |
| 2003/0059610 | A1 | * 3/2003 | Khavkine et al. | 428/373 |
| 2003/0157323 | A1 | * 8/2003 | Khavkine et al. | 428/373 |
| 2003/0205041 | A1 | * 11/2003 | Baker, Jr. | 57/224 |

FOREIGN PATENT DOCUMENTS

| | | |
|---|---|---|
| DE | A3408769 | 9/1985 |
| DE | A4042063 | 7/1992 |
| EP | 156599 | 10/1985 |
| EP | 156600 | 10/1985 |
| EP | A0268838 | 6/1988 |
| EP | 351201 | 1/1990 |
| EP | 378381 | 7/1990 |
| EP | 466618 | 1/1992 |
| GB | 2090849 A | 7/1982 |
| JP | 4353525 | 12/1992 |
| JP | 8280418 | 10/1996 |
| WO | WO 9933639 | 7/1999 |

OTHER PUBLICATIONS

AgFiber Technology News, Oct. 31, 2000, vol. 2, No. 13, Issue 37.

Byung–Dae Park and John J. Balatinecz, A Comparison of Compounding Processes for Wood–Fiber/Thermoplastic Composites, Polymer Composites, Jun. 1997, p. 425, vol. 18, No. 3.

P.R. Hornsby, E. Hinrichsen and K. Tarverdi, Preparation and properties of polypropylene composites reinforced with wheat and flax straw fibres, Journal of Materials Science, Jan. 15, 1997, vol. 32, No. 2.

Billie J. Collier and Phyllis G. Tortora, "Understanding Textiles," Sixth Edition, pp. 250–262, undated.

H. Gilbertson, "British Flax Fibre–New Markets," 4$^{th}$ Workshop of the FAO Network on Flax, Rouen, France, Sep. 25/28, 1996.

A.J. Michell and D. Wilis, "Cellullosic Fibres for Reinforcement," Mar. 1978, presented at 31$^{st}$ Annual Conference, Surfers Paradise, 1977.

K.P. Mieck, R. Lutzkendorf and T. Reussman, "Needle–Punched Hybrid Nonwovens of Flax and PPFibers–Textile Semiproducts for Manufacturing of Fiber Composites," Polymer Composites Dec. 1996, vol. 17, No. 6.

* cited by examiner

*Primary Examiner*—Cynthia Kelly
*Assistant Examiner*—J. Gray
(74) *Attorney, Agent, or Firm*—David J. Untener

(57) ABSTRACT

The invention is directed to hybrid yarns which include plant bast fibers and thermoplastic fibers, reinforcing fabrics made from such yarns, and reinforced composites made from such yarns and fabrics.

15 Claims, No Drawings

HYBRID YARNS WHICH INCLUDE PLANT BAST FIBER AND THERMOPLASTIC FIBER, REINFORCEMENT FABRICS MADE WITH SUCH YARNS AND THERMOFORMABLE COMPOSITES MADE WITH SUCH YARNS AND REINFORCEMENT FABRICS

The present application is a non-provisional application claiming priority under 35 USC 119(e) to U.S. Provisional Application No. 60/290,840, of Khavkine et al., entitled HYBRID YARNS WHICH INCLUDE PLANT BAST FIBRE AND THERMOPLASTIC FIBER, REINFORCEMENT FABRICS MADE WITH SUCH YARNS AND THERMOFORMABLE COMPOSITES MADE WITH SUCH YARNS AND REINFORCEMENT FABRICS, filed May 14, 2001.

The invention is directed to hybrid yarns which include natural fibers and thermoplastic fibers, reinforcing fabrics made from such yarns, and reinforced composites made from such yarns and fabrics. The yarns and reinforcing fabrics are particularly useful for low to medium strength applications. The yarns and reinforcing fabrics of the invention are environmentally-friendly alternative to fiberglass based composite reinforcements. The significant advantages of the invention include the use of natural plant bast fibers in combination with thermoplastic fibers which provide thermoformable properties for the reinforcing yarn and fabric of the invention which properties are effective to permit efficient shaping into a fibre preform.

BACKGROUND OF THE INVENTION

A number of different materials, such as organic and inorganic fibers, have been used to make composite reinforcements, particularly reinforcements for low and medium strength applications. Inorganic fibers include glass and carbon filaments, filaments of metals or metal alloys such as steel, aluminum or tungsten; non metals such as boron; or metal or nonmetal oxides, carbides or nitrides such as aluminum oxide, zirconium oxide, boron nitride, boron carbide or silicon carbide, ceramic filaments, filaments of slag, stone or quartz. Organic fibers include aramid, nylon, polypropylene, polyethylene, polyester and natural fibers, such as cotton and wood.

Traditionally, fiberglass has been the most popular material for almost any composite reinforcement application. Fiberglass has unique combination of versatility and strength that made this reinforcement a material of choice for more than 50% of all composite articles manufactured in the year 2000. Nylon, polyester, and polypropylene fibers are another composite reinforcement alternative. They have been used extensively for low and medium strength composite reinforcement applications. Despite their good availability fiberglass, nylon, polyester, and polypropylene fibers have significant disadvantages, including high prices tied to crude oil prices. All of these materials pressure the environment because they are not necessarily renewable, do not biodegrade and generate significant Green House Gases emission upon manufacture and/or destruction. Key disadvantages of fiberglass also include the worker unfriendly nature of the material (fiberglass is an irritant), its fragility which makes it difficult to process; and finally, its density (natural fibers have specific density that is 40% less than density of fiberglass).

Hybrid yarns from non-thermoplastic reinforcement filaments (e.g. aramid, glass or carbon fiber) and thermoplastic filaments (e.g. polyester fiber) are well known. For instance, the patent applications EP-A-0,156,599; EP-A-0,156,600; EP-A-0,351,201 and EP-A-0,378,381 as well as Japanese Publication JP-A-04/353,525 and U.S. Pat. No. 5,792,555 consider hybrid yarns made of non-thermoplastic fibers (e.g. glass or aramid filaments or rovings) and thermoplastic fibers (e.g. polyester or PET filaments or rovings). Thermoformable textile materials (e.g. plain weave fabrics) are made from thermoformable hybrid yarns having high melting point and non-melting filament or fibers. These textile materials can be converted into fiber reinforced, stiff thermoplastic sheets that may be used for different structural applications.

Various methods of producing fiber reinforced thermoplastic sheets are described in Chemiefasern/Textiltechnik, volume 39/91 (1989) pages T185 to T187, T224 to T228 and T236 to T240. Processes are described which start with a woven mat composed of hybrid yarns. The advantage of these techniques are a mixing ratio of reinforcing and matrix fibers that can be very precisely controlled, as well as the drapability of the textile materials which makes it easy to process the material by compression moulding (Chemiefasern/Textiltechnik, volume 39/91 (1989), page T186).

EP-A-0,268,838 describes reinforcing textile material a layer of longitudinal threads and a layer of transverse threads, which are not interwoven. One of the plies of threads has a significantly higher heat shrinkage capacity than the other. Auxiliary threads provide cohesion. These auxiliary threads do not tightly bind the layers of the reinforcing threads together, but rather loosely fix them to one another so that they can move relative to one another.

DE-A-4,042,063 describes making easily deformed reinforcing layers. Longitudinal heat-shrinking and auxiliary threads are incorporated into a sheet material intended for use as textile reinforcement. Heating causes the textile material to contract as some extent, so that the reinforcing threads are held in a wavy state or in a loose looping.

U.S. Pat. No. 6,51,313 describes yarn that is formed from non-twisted discontinuous parallel fibers held together by a covering yarn of sacrificial material wound around the fibers. The fibers comprise an intimate mixture of fibers of at least two different types: 1) carbon fibers or pre-oxidized polyacrylonitrile based carbon precursor fibers, 2) anisotropic or isotropic pitch based carbon precursor fibers, 3) phenolic or cellulosic based carbon precursor fibers, and 4) ceramic fibers or ceramic precursor fibers. In a carbon state, the mixture of fibers comprises at least 15% by weight of high strength fibers having a tensile strength of at least 1500 Mpa and a modulus of at least 150 Mpa, and at least 15% by weight of fibers with a low Young's modulus of at most 100 GPa.

DE-A-3,408,769 discloses a process for producing shaped fiber reinforced articles from thermoplastic material by using flexible textile structures consisting of substantially unidirectional aligned reinforcing fibers and a matrix constructed from thermoplastic yarns or fibers. Final shaping of a composite takes place after passing heated dies where virtually all of the thermoplastic fibers melt and bind the reinforcement.

SUMMARY OF THE INVENTION

This invention relates to hybrid yarns which include natural bast fibers, composite reinforcements made from such yarns, and a process for making such yarns. The composite reinforcements are particularly suitable for low to medium strength composite reinforcement applications. The yarns and reinforcement of the invention advantageously include plant fibers that otherwise would be burned on the field and contribute to the Green House Gases emission.

The hybrid yarns of the invention comprise short staple natural plant bast fibers and thermoplastic matrix filaments which are effective for making yarns having a tenacity of at least about 0.8 grams/Denier and a Young's tensile modulus of at least about 6 g/Denier. Further the hybrid yarns of the present invention are capable of permanent deformation. The deformation property provides a unique deep-draw characteristic to the open textile sheet materials produced from the yarn. The reinforcement fabric of the invention is an open thermoformable mat that is capable of being used for manufacturing reinforced composite articles which are produced by deforming the thermoformable textile sheet-like mats of the invention. The open thermoformable woven mat can be uni- or multidirectionally placed to provide an article having an adjustable high strength in two or more directions.

The hybrid yarns of the invention include at least two groups which are twisted together to form the yarn. The first group includes plant bast fibers having a tenacity of at least about 1.5 grams/Denier, a breaking elongation of from about 1 to about 20% and a crimp of from about 5 to about 80%. The second group comprises at least one thermoplastic filament having a melting point of at least about 10° C. and below the thermal decomposition point of the plant bast fibers.

Almost any natural bast fiber such as non-oil seed plant bast fibers can be used in the invention. Jute, flax, sisal, ramie, hemp and kenaf can be successfully processed into the hybrid yarn and composite reinforcement of the invention. The plants from which the bast fibers used in the invention come have bast fibers separable from the shives in the stem of the plant. As used herein, "bast" refers to those fibers from the phloem region. "Shives" refers to the core tissue particles that remain after the bast fibers are separated from the plant stem. The thermoplastic fibers or filaments (e.g. polypropylene or polyester) serve as binder for the composite and also help to process the hybrid yarn on textile equipment. The yarn is processed by short staple ring spinning from chopped bast fibers with an average fiber length about 15–75 mm and thermoplastic filaments. The yarn may be woven into a large variety of textile products, particularly into open mat type products; and more particularly into open mat products with openings that have an area in a range of 0.2 to about 100 $mm^2$. The significant advantage of the natural fiber based yarns over fiberglass, carbon and other stiff high performance fibers is the ease of processing natural fiber based yarns into a variety of textile products cost effectively on a very large scale.

The bast fibers of the present invention are blended with a hydrophobic lubricant and antistat during blending of the bast fibers with the thermoplastic filaments and prior to carding. Bast fibers are treated with an amount of hydrophobic lubricant and antistat that is effective for increasing the affinity of the bast fibers to the surface of the thermoplastic filaments. The hybrid yarn will include about 0.1% to about 0.5% of hydrophobic lubricant, based on the dry weight of the fibers, and from about 0.1% to about 1% of antistat, based on the dry weight of the fibers. Preferably, the hybrid yarn will include about 0.2% to about 0.3% hydrophobic lubricant, based on the dry weight of the fibers, and a weight ratio of hydrophobic lubricant to antistat of about 80 to 20. A hybrid yarn of the invention having a moisture content of about 12% will have at least about 0.3% by weight hydrophobic lubricant and at least about 0.2% by weight antistat.

The hydrophobic lubricant of the invention includes compositions that contain nonionic hydrocarbon surfactants and lubricant bases that include alkyl phosphate esters, alkyl esters of fatty acids, polyoxyethylene lauryl ether and polyoxyethylene tridecyl ether blended in an inert carrier. Antistats of the present invention include antistat compositions having at least one neutralized $C_3$–$C_{12}$ alkyl or alkenyl phosphate alkali metal or alkali earth metal and a solubilizer.

The surface characteristics of the bast fibers are enhanced such that they are effective for spinning when treated as described above with hydrophobic lubricant and antistat.

The reinforced composites of the invention include either the yarns or the woven open mats of the invention. A yarn is formed from short staple natural fibers and thermoplastic filaments using ring spinning technology. The combination of natural and thermoplastic fibers provides prepreg properties for the reinforcement. The mixture of fibers comprises at least 15% by weight of natural fibers and at least 1% by weight of thermoplastic fibers.

It has been found that yarns in the prior art have significant disadvantage for low to medium strength composite reinforcement applications. Known reinforcements are designed for high performance applications and they are too expensive for broad use in cost sensitive applications like construction materials and interior trim automotive parts. Another disadvantage of reinforcing materials described in the previous art is difficulty in handling of these materials due to their irritant nature (e.g. fiberglass and carbon fibers).

DETAILED DESCRIPTION OF THE INVENTION

The hybrid yarns of the invention consists of two groups of fibers or filaments. The first group has one or more varieties of natural bast fibers including non-oilseed plant bast fibers. A second group has one or more thermoplastic fibers or filaments. The fibers of the first group have fiber tenacity of above 1.5 gram/Denier, preferably of 2 to 8 gram/Denier, in particular of 2.5 to 7 gram/Denier, and a breaking elongation of 1 to 20%, preferably of 2 to 10%, in particular of 2.5 to 5.0%. The filaments of the second group are thermoplastic filaments which have a melting point which is at least 10° C., preferably 20° to 225° C., below the thermal decomposition point of the natural bast fibers. The filaments of the first group have a crimp of 5% to 80%, preferably of 12 to 50%, in particular of 18 to 40%.

The advantage of the described reinforcing hybrid yarn is that the yarn is produced by ring spinning which provides a high degree of twisting. The twisted yarns have a significant advantage in terms of tensile properties over non-spun filament bundles or other types of spinning that does not put a strong twist on the yarn. Ring spinning enables relatively weak fibers to form strong yarns. At the same time, any spun yarns have significant advantage over yarns made from non-spun filaments (e.g. fiberglass yarns), due to bundle coherency. The hybrid yarn is easier to process into sheet materials on conventional machines, for example weaving or knitting machines. This is very important for a thermoformable composition where intimate mixing of the reinforcing and matrix fibers results in very short flow paths for the molten matrix material. This property provides superior and complete embedding of the reinforcing fibers in the thermoplastic matrix; e.g., when a sheet moulding material is shaped into fiber reinforced thermoplastic composite article.

It is important that the bast fibers used in the invention are not weakened by virtue of their separation from the plant and the woody or shive portion of the plant. The latter "woody" portion is generally from the inner core of the stalk of the plant. Many processes for isolating bast fibers from the plant include chemical treatment and machines which use a scutching, beating or failing action as a primary separation mechanism. Many of these processes weaken the bast fibers. This weakening ultimately causes breakage and shortening of the fibers. In view of this circumstance, bast fibers which are recovered from other plant materials such as shives by the processes and equipment described in U.S. Pat. Nos. 5,720,083; 5,906,030; and 6,079,647 are ideal for recovering bast fibers which may be used in the invention.

In addition to having strong bast fibers having an average length of from about 15 mm to about 75 mm, the surface characteristics of the bast fibers blended with hydrophobic lubricant and antistat as described herein are enhanced such that the fibers are effective for use in open end and ring spinning.

To make the yarn of the invention, the two groups of fibers are blended, carded, drawn and spun. During blending of the bast fibers with thermoformable filaments and prior to carding, the bast fibers are blended with a lubricant and antistat to provide a hybrid yarn having at least about 0.1% to about 0.5% of hydrophobic lubricant, based on the dry weight of the fibers, and from about 0.1% to about 1% of antistat, based on the dry weight of the fibers. Preferably, the hybrid yarn will include about 0.2% to about 0.3% hydrophobic lubricant, based on the dry weight of the fibers, and a weight ratio of hydrophobic lubricant to antistat of about 80 to 20.

Lubricants that may be blended with the bast fibers include lubricants containing nonionic hydrocarbon surfactants such as polyoxyethylene, polyethylene glycol 400 distearate, polyethylene glycol 300 distearate, polyethylene glycol 200 distearate, polyethylene 600 distearamide, and glycerol monosterate. Other suitable lubricants include self-emulsifiable, textile-fiber, lubricant bases and lubricant compositions. Effective lubricant bases include from about 2% to about 20% sodium or potassium alkyl phosphate ester, from about 15% to about 50% alkyl ester of a fatty acid, from about 25% to about 45% polyoxyethylene lauryl ether, and from about 5% to about 25% polyoxyethylene tridecyl ether. The lubricant bases are mixed with inert carrier liquids such as mineral oil or aqueous solutions and then applied to the bast fibers. The amount of lubricant blended with the bast fibers is effective for providing a coefficient of friction of less than about 0.35.

Antistatic compositions that can be used in the present invention includes antistats that include at least one neutralized $C_3$–$C_{12}$ alkenyl phosphate alkali metal or alkali earth metal salt and a solubilizer. Solubilizers include glycols, polyglycols, diethylene glycol, polyethylene glycol, and potassium or sodium oleyl (ethylene oxide) phosphate having an ethylene content range of from about 2 to about 9 moles. The amount of antistat blended with the bast fibers is effective for limiting electrostatic charge to less than about 4000 volts during processing, and in a preferred aspect, to less than about 500 volts during processing.

Hydrophobic lubricant and antistat may be applied during a fiber blending stage, for example, in a low speed blender, and before carding. In this aspect of the invention, hydrophobic emulsions of lubricant and antistat may be simultaneously sprayed with jet sprayers onto the fibers.

An advantage of the reinforcing hybrid yarn of the invention is that the yarn is produced by ring spinning which provides a high degree of twisting. The twisted yarns have a significant advantage in terms of tensile properties over non-spun filament bundles or other types of spinning that does not put a strong twist on the yarn. Ring spinning enables relatively weak fibers to form strong yarns. At the same time, any spun yarns have significant advantage over yarns made from non-spun filaments (e.g. fiberglass yarns), due to bundle coherency. The hybrid yarn is easier to process into sheet materials on conventional machines, for example weaving or knitting machines. This is very important for a thermoformable composition where intimate mixing of the reinforcing and matrix fibers results in very short flow paths for the molten matrix material. This property provides superior and complete embedding of the reinforcing fibers in the thermoplastic matrix; e.g., when a sheet moulding material is shaped into fiber reinforced thermoplastic composite article.

As used herein, the term thermoplastic filament or fiber means a fiber or filament made from a resin including polypropylene (PP), polyethylene (PE), polyvinyl chloride (PVC), styrene resins, acrylonitrile resins, acrylonitrile-styrene resin (ABS) and the like, their compounded mixtures, their copolymers, their reactive modified resins and the like. The thermoplastic filaments of the hybrid yarn have a melting point which is at least 10° C., preferably 20° to 225° C., below the thermal decomposition point of the bast fibers. These thermoplastic filaments have a crimp of 5% to 80%, preferably of 12 to 50%, in particular of 18 to 40%. In this aspect, the hybrid yarn is easier to process into sheet materials on conventional machines, for example weaving or knitting machines. This is very important for a thermoformable composition where intimate mixing of the reinforcing and matrix fibers results in very short flow paths for the molten matrix material. This property provides superior and complete embedding of the reinforcing fibers in the thermoplastic matrix; e.g., when a sheet moulding material is shaped into fiber reinforced thermoplastic composite article.

The present invention is effective for providing permanently deformed composite material that includes the hybrid yarn that is a combination of themoplastic filaments and bast fibers. "Permanent deformation" or "permanently deformed" refers to a property of the composite material where a composite material that is formed under heat and pressure retains its shape indefinitely or until the article is destroyed.

What is claimed is:

1. A method for preparing a hybrid yam comprising a first fiber group and a second filament group, the method comprising:

spinning together the first fiber group and: the second filament group, wherein the first fiber group comprises flax, plant bast fibers having a tenacity of at least about 1.5 grams/Denier, a breaking elongation of from about 1 to about 20% and a crimp of from about 5 to about 80%;

wherein a second filament group comprises at least one thermoplastic filament having a melting point of at least about 10° C. and below the thermal decomposition point of the plant bast fibers.

2. The method as recited in claim 1, wherein the plant bast fibers have a length of from about 15 mm to about 75 mm.

3. The method as recited in claim 2 wherein the first group and second group are ring spun into a yarn.

4. The method as recited in claim 3, wherein the thermoplastic filament of the second filament group is selected from the group consisting of polypropylene filament, polyester filament, polyethylene filament, polyvinyl chloride filament, polyurethane filament and mixtures thereof.

5. The method as recited in claim 4, wherein the two groups have been twisted and each group is in an effective amount for providing a yarn with a tenacity of at least about 0.8 grams/Denier.

6. A method for making a hydrid yarn comprising at least two groups, a first bast fiber group and a second filament group:

mixing the first bast fiber group, the second filament group, a hydrophobic lubricant and a antistat to provide a lubricated fiber/filament group; and spinning the lubricated fiber/filament group, wherein the first bast fiber group is selected from the group consisting of jute best fibers, sisal best fibers, ramie bast fibers, hemp bast fibers, kenaf bast fibers and mixtures thereof and the fibers of the bast fiber group having a length of from about 15 mm to about 75 mm, a tenacity of at least about 1.5 grams/Denier, a breaking elongation of from about 1 to about 20% and a crimp of from about 5 to about 80%, wherein the second filament group comprises at least one thermoplastic filament having a melting point of at least about 10° C. and below the thermal decomposition point of the plant but fibers, the first fiber group and second filament group being in amounts effective for providing a yarn with a tenacity of at least about 0.8 grams/Denier.

7. The method as recited in claim 6, wherein the bast fibers are a blend of more than one type of bast fiber which comes from more than one type of plant.

8. The method as recited in claim 7, wherein the thermoplastic filament of the second filament group is selected from the group consisting of polypropylene filament, polyester filament, polyethylene filament, polyvinyl chloride filament, polyurethane filament and mixtures thereof.

9. The method as recited in claim 8, wherein the first group and second group are ring spun to a yarn.

10. The method as recited in claim 7, wherein the first group and second group are ring spun to a yarn.

11. A method for preparing a hybrid yarn comprising a first fiber group and a second filament group, the method comprising:

spinning together the first fiber group and the second filament group, wherein the first fiber group comprises flax plant bast fibers having a length of from about 15 mm to about 75 mm, a tenacity of at least about 1.5 grams/Denier, a breaking elongation of from about 1 to about 20% and a crimp of from about 5 to about 80%, the two groups being twisted and each group is in an effective amount for providing a yam with a tenacity of at least about 0.8 grams/Denier;

wherein the second filament group comprises at least one thermoplastic filament having a melting point of at least about 10° C. and below the thermal decomposition point of the plant bast fibers.

12. The method as recited in claim 11, wherein the first group and second group are ring spun into a yarn.

13. The method as recited in claim 12, wherein the thermoplastic filament of the second filament group is selected from the group consisting of polypropylene filament, polyester filament, polyethylene filament, polyvinyl chloride filament, polyurethane filament and mixtures thereof.

14. A method for making a hybrid yarn comprising at least two groups, a first bast fiber group and a second filament group:

mixing a blend of bast fibers from the first bast fiber group, the second filament group, a hydrophobic lubricant and a antistat to provide a lubricated fiber/filament group, the blend of bast fibers being from more than one type of bast fiber which comes from more than one type of plant; and ring spinning the lubricated fiber/filament group into a yarn, wherein the first bast fiber group is selected from the group consisting of jute bast fibers, sisal bast fibers, ramie bast fibers, hemp bast fibers, kenaf bast fibers and mixtures thereof and the fibers of the best fiber group having a length of from about 15 mm to about 75 mm, a tenacity of at least about 1.5 grams/Denier, a breaking elongation of from about 1 to about 20% and a crimp of from about 5 to about 80%, wherein the second filament group comprises at least one thermoplastic filament having a melting point of at least about 10° C. and below the thermal decomposition point of the plant bast fibers, wherein the first fiber group and second filament group being in amounts effective for providing a yarn with a tenacity of at least about 0.8 grams/Denier.

15. The method as recited in claim 15, wherein the thermoplastic filaments of the second filament group are selected from the group consisting of polypropylene filament, polyester filament, polyethylene filament, polyvinyl chloride filament, polyurethane filament and mixtures thereof.

* * * * *